US005542552A

United States Patent [19]

Yablans et al.

[11] Patent Number: 5,542,552

[45] Date of Patent: Aug. 6, 1996

[54] ADJUSTABLE DISPLAY AND DISPENSER RACK

[75] Inventors: Gerald Yablans, Port Washington; Anthony Chan, Bethpage, both of N.Y.

[73] Assignee: P.O.P. Displays, Inc., Woodside, N.Y.

[21] Appl. No.: 222,605

[22] Filed: Apr. 4, 1994

[51] Int. Cl.[6] ..... A47F 7/00

[52] U.S. Cl. ..... 211/59.3; 211/43

[58] Field of Search ..... 211/59.3, 59.2, 211/175, 184, 43; 312/61, 71, 42

[56] References Cited

U.S. PATENT DOCUMENTS

| | | | |
|---|---|---|---|
| 4,331,245 | 5/1982 | Schell | 211/49 D |
| 4,364,481 | 12/1982 | Ricci | 211/184 |
| 4,478,337 | 10/1984 | Flum | 211/59.2 |
| 4,685,574 | 8/1987 | Young et al. | 211/59.2 |
| 4,706,821 | 11/1987 | Kohls | 211/59.3 |
| 4,712,694 | 12/1987 | Breslow . | |
| 4,724,968 | 2/1988 | Wombacher | 211/59.3 |
| 4,730,741 | 3/1988 | Jackle, III et al. | 211/59.3 |
| 4,742,936 | 5/1988 | Rein | 221/5 |
| 4,762,235 | 8/1988 | Howard | 211/59.3 |
| 4,762,236 | 8/1988 | Jackle, III et al. | 211/59.3 |
| 4,830,201 | 5/1989 | Breslow | 211/184 |
| 4,901,869 | 2/1990 | Hawkinson | 211/59.3 |
| 4,905,847 | 3/1990 | Hanson | 211/DIG. 1 |
| 4,907,707 | 3/1990 | Crum | 211/59.3 |
| 4,923,070 | 5/1990 | Jackle et al. | 211/59.2 |
| 5,024,336 | 6/1991 | Spamer | 211/59.2 |
| 5,027,957 | 7/1991 | Skalski | 211/59.3 |
| 5,069,349 | 12/1991 | Wear | 211/59.3 |
| 5,111,942 | 5/1992 | Bernardin | 211/59.3 |
| 5,240,126 | 8/1993 | Foster et al. | 211/59.3 |

*Primary Examiner*—Karen J. Chotkowski
*Assistant Examiner*—Anita M. King
*Attorney, Agent, or Firm*—Nolte, Nolte, and Hunter, P.C.

[57] ABSTRACT

A display and dispensing rack having a pair of front-to-back slidingly interfitted trays with product pusher which travels front-to-back over both trays.

12 Claims, 5 Drawing Sheets

ADJUSTABLE DISPLAY AND DISPENSER RACK

BACKGROUND OF THE INVENTION

1. Field of the Invention

This invention relates generally to merchandise display and dispenser racks, more particularly to a rack which is adjustable to and from both short and long lengths to accommodate shelf depth, and which incorporates package support tracks, push plate slots and a push plate biased to move packages of product through the length of the rack forwardly in all adjusted lengths of the rack. The rack of the invention may also provide side-by-side product dispensing channels as well as side-by-side single product dispensing channels with lateral locking elements stabilizing the joined racks.

2. Description of the Prior art

In co-pending application Ser. No. 882,814, filed May 14, 1992, there is a disclosed shelf dispenser for packaged merchandise which may be shortened in front-to-back length to accommodate the different depth of shelves commonly used in retail stores having shelf stored and displayed products. The dispenser of that application is provided with weakened areas along its length so that portions of the display structures may be broken off and discarded.

The merchandise display and dispenser art was searched and the following patents were determined to be of interest:

U.S. Pat. No. 4,331,245, patented May 25, 1982 by D. Schell, discloses shelf members having walls dividing them into narrow side-by-side trays;

U.S. Pat. No. 4,706,821, patented Nov. 17, 1987 by Kohls et al., discloses a dispensing shelf having a slot, a product push plate supported over the slot on low friction glides, guide pins holding the push plate in place and a spring to bias the push plate to the end of the slot;

U.S. Pat. No. 4,742,936, patented May 10, 1988 by G. Rein, discloses a dispenser tray for dispensing a plurality of items which are eased forward by an upright platform that is biased to push remaining items in the tray forward, on removal of a first item.

U.S. Pat. No. 4,762,235, patented by Howard et al. Aug. 9, 1988, discloses a plurality of trays supported horizontally and vertically at their rear ends by releasable attachments between splines on successively spaced vertical frame members;

U.S. Pat. No. 4,762,236, patented Aug. 9, 1988 by Jackle, III et al., discloses a tray system having front and rear walls forming side-by-side trays with guide members and pusher members operated by coil springs;

U.S. Pat. No. 4,830,201, patented by D. Breslow May 16, 1989, also discloses a spring-urged shelf divider system where the product is supported on tracks and pushed forward by a spring-urged pusher;

U.S. Pat. No. 4,901,869, patented by Hawkinson et al. Feb. 20, 1990, discloses a series of side-by-side product display and dispenser chutes having height and width selected by snapping away portions at grooves running from the front to the back of the chutes;

U.S. Pat. No. 4,907,707, patented Mar. 13, 1990 by P. Crum, provides a slidably mounted product display and dispensing tray;

U.S. Pat. No. 5,027,957, patented Jul. 2, 1991 by J. Skalski, discloses a pair of strip coils to draw the product towards the front of the display device;

U.S. Pat. No. 5,069,349, patented Dec. 3, 1991 by Wear et al., discloses a multi-level spring biased backing member to forward the product.

U.S. Pat. No. 5,111,942, patented by Bernardin May 12, 1992, proposes to provide a display tray composed of fore-to-aft modules to shorten or lengthen the depth of the display tray similar to the display disclosed in co-pending application Ser. No. 882,814 which is shortened in front-to-back length by discarding portions of the display which are taken off the end of the display structure.

SUMMARY OF THE INVENTION

The present invention provides an adjustable rack comprised of a front tray and back tray for displaying merchandise and feeding the merchandise forward on a store shelf. The front and back trays are interfitted and are movable relative to one another forwardly and rearwardly to extend or shorten the rack.

In one aspect of the invention, the rack of the invention defines laterally adjacent trays, extending front-to-back of the rack, each with sides and a pair of track elements connected at the front end of the floor of the front tray. The tracks are on either side of a central slot for supporting a product push trolley, as well as the packaged product, with the trolley and product drawn along the tracks by a coiled spring mounted on the trolley and secured at a free end to the front of its respective tray, to thus push the product forwardly.

A pair of guide slots, one guide slot on either side of and parallel to the central slot are formed in the front tray floor and run coextensively with the central slot, all three terminating with the back end of the front tray where the guide slots receive tracks of the back tray which slidingly, progressively, interfit with the guide slots of the front tray as the trays are telescoped to form a shorter tray.

The back tray also has a central slot between the back tray tracks within which the trolley rides and which leads into the central slot of the front tray which receives the sliding trolley without interruption. The front and rear tracks are formed along their bottom extensions with indents and detents for vertical stability of the interfitted trays in a plurality of fore and aft positions when shortening or lengthening the rack.

It is contemplated within the invention to provide a rack which includes a set of interfitted front and back trays in which product is displayed and dispensed, and to provide such a rack with connecting elements along the sides to join similar single channel racks in side-by-side disposition.

Interfitting means for joining a first front and second back tray comprises the trays and joins them in a plurality of positions in which portions of the first and second trays each occupy a same front-to-back distance portion of the rack between the front and back ends of the rack, the front-to-back distance portion increasing when the second tray position is moved toward the front end of the rack.

The interfitting means comprises track and slot means cooperating between the first and second trays. The track and slot means are preferably continuous one with the other, extending over considerably the full front-to-back length of each of the first and second trays, and oriented front-to-back with respect to the rack.

The track and slot means further include a pair each of upward, downward, laterally leftward, and laterally rightward engagement surfaces for limiting vertical and lateral displacement of the first tray from the second tray when the first and second trays are interfitted.

Means for resisting rearward movement of items in the first tray is mounted on the rack so that the means for resisting is movable on the rack between the front end and the back end of the rack over the first and second trays.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
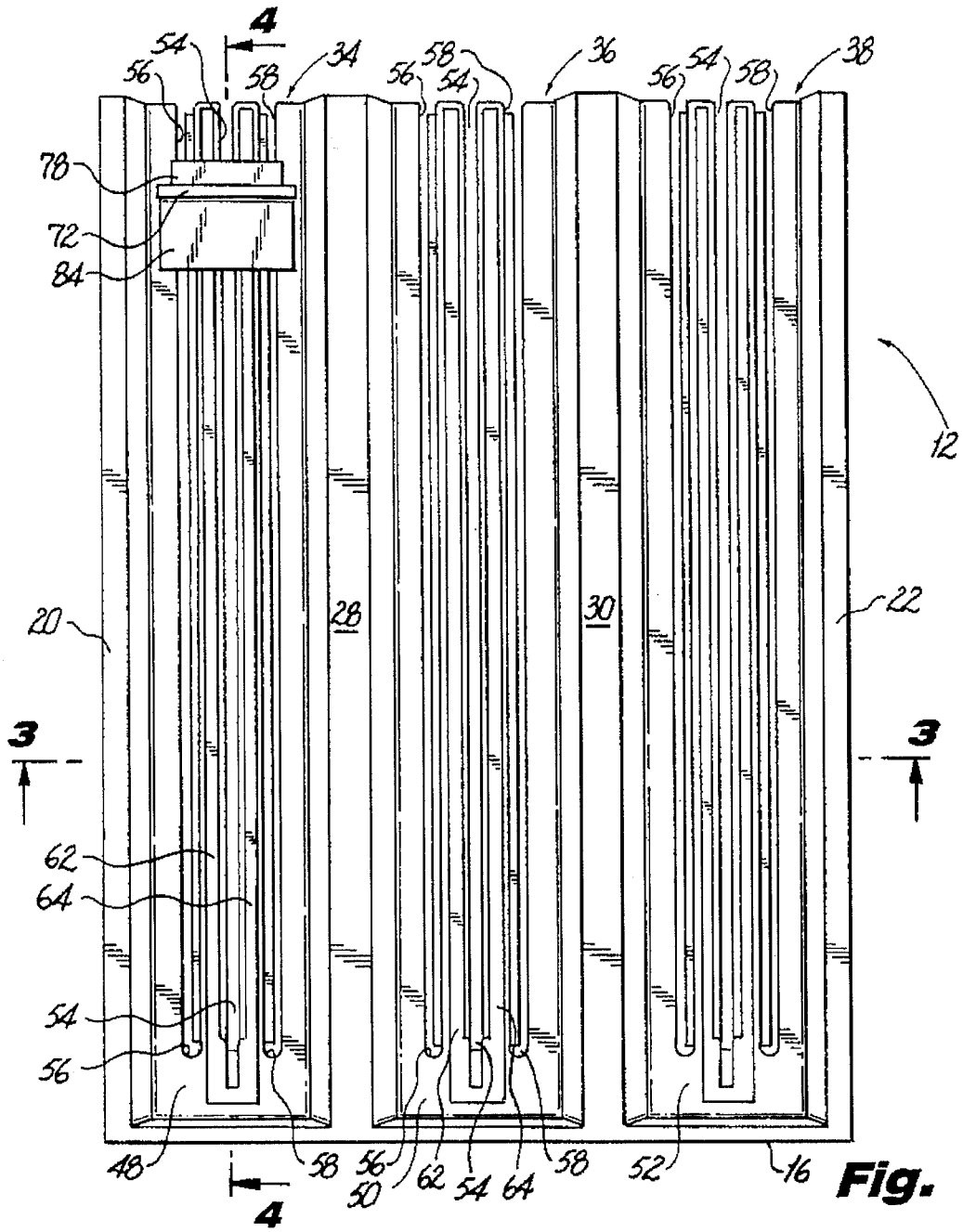
FIG. 1 is a top plan view of the front tray of the rack of the invention.
Figure 2:
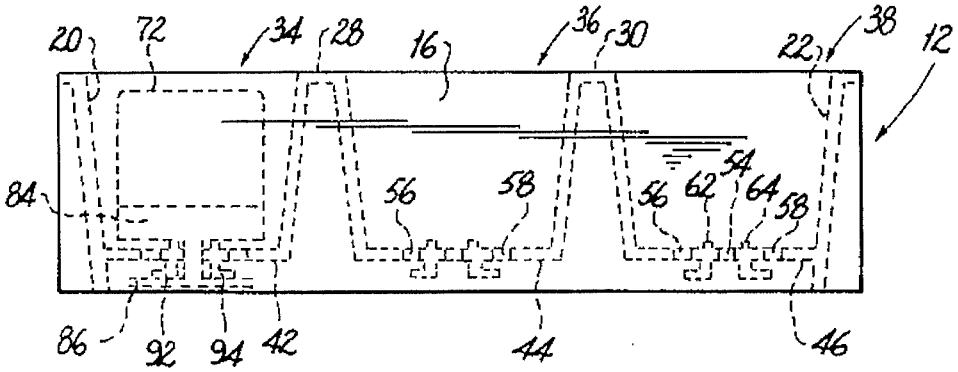
FIG. 2 is a frontal view of the front tray shown in FIG. 1.
Figure 3:
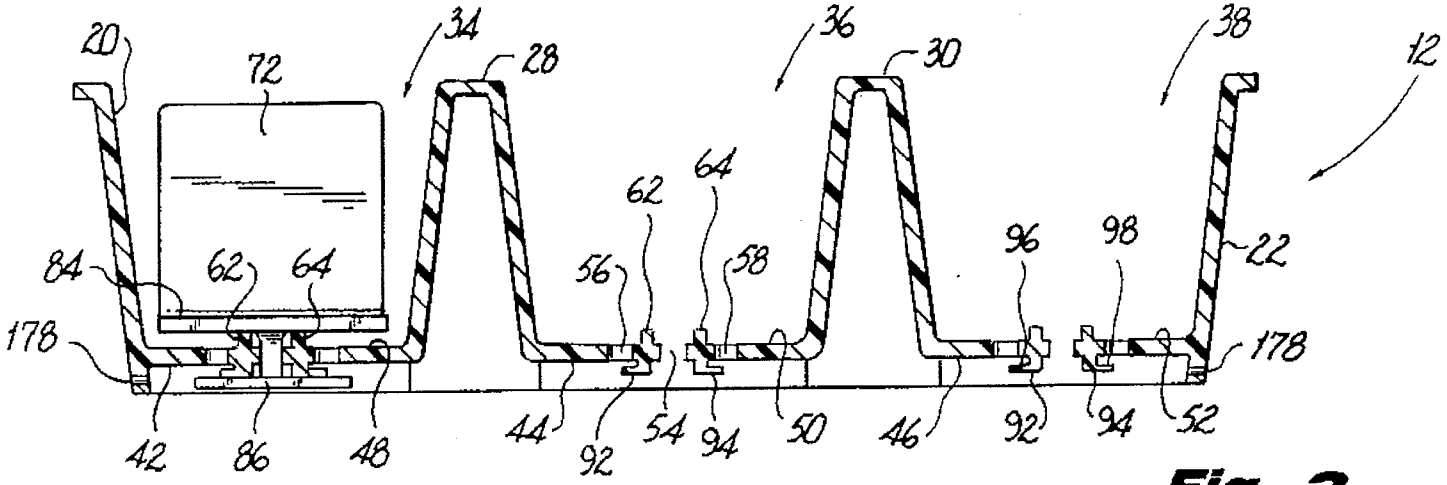
FIG. 3 is a section taken along the line 3—3 of FIG. 1.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to FIGS. 1–4, front tray 12 is an integral molded unit of a strong, rigid plastic having front wall 16, side walls 20 and 22, and divider walls 28 and 30 defining three channels 34, 36, and 38. In each channel, a floor 48, 50 and 52 respectively defines a central slot 54 and associated tracks and slots which are preferably identical for each channel.

Slot 54 extends toward the front and back of the channel. To the left and right sides respectively of slot 54 are raised tracks 62 and 64, each generally parallel with adjacent slot 54. On the outboard sides of each track 62 and 64 are guide slots 56 and 58 respectively, each generally parallel with the adjacent track.

The channels and slots are integral with the floor at the front end of the tray and extend to the back of the front tray. The channels and the central slot open to free ends at the back of the front tray.

Figure 4:
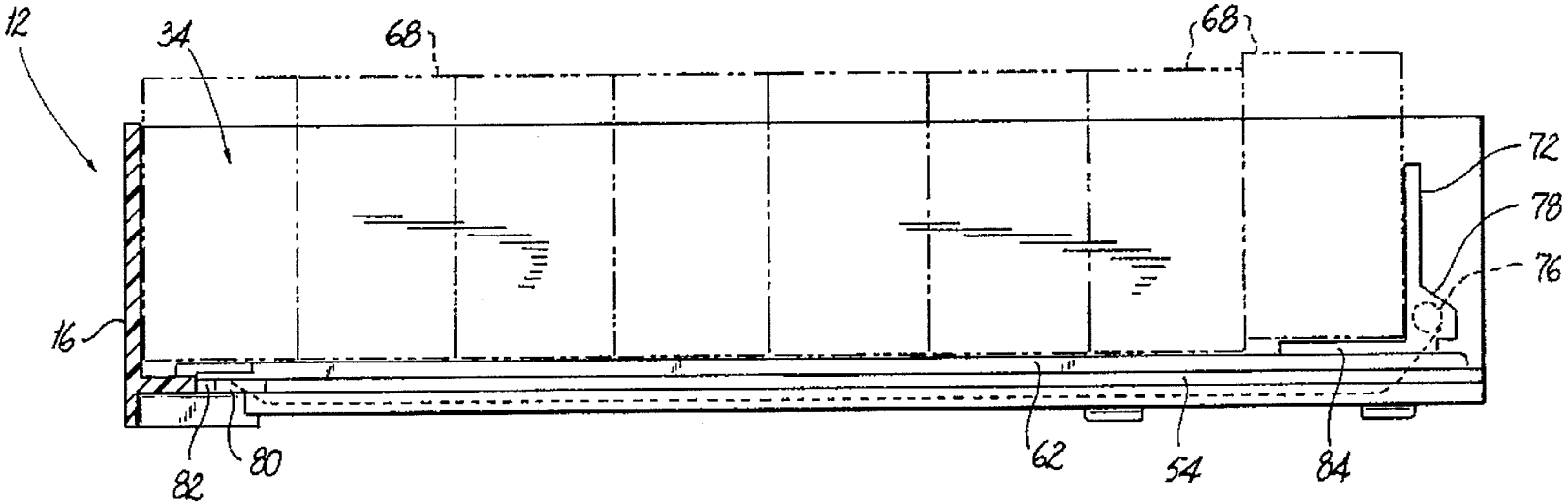
FIG. 4 is a section taken along the line 4—4 of FIG. 1.

The tracks extend above the floor as support and slide rails for packaged products 68 which are stored one in front of the other in each channel. In each channel, behind the packaged products, is a product pusher plate 72. One is shown in channel 34. When the channel is full, the product pusher is at the back of the tray, as shown in FIG. 4.

Product pusher plate 72 basically resists rearward movement of items in the channel. It is preferably biased, to urge the items toward the front of the tray.

In channel 34, product pusher plate 72 is biased forward by coil spring 76 mounted on back platform 78 of the pusher. Free end 80 of spring 76 is secured to spring mount 82 which is integrally formed with floor 48 at the front end of channel 34 of tray 12.

The afore described biased pusher arrangement is also preferably installed in each of channel 36 and 38. It is preferably identical to the one in channel 34, and not shown in the FIGS.

Slide shoe 84 of pusher plate 72 rides on raised tracks 62 and 64 over the floor of the channel. Foot 86 of plate 72 rides under the floor of the channel, and bears slidingly against lower L track sections 92 and 94. Foot 86 is preferably about the same length front-to-back as pusher plate 72 and slide shoe 84 combined, and extends laterally below the first and second trays. The foot and slide shoe cooperate to keep pusher plate 72 vertical against torquing force between the plate and the packaged product against which it bears.

Figure 7:
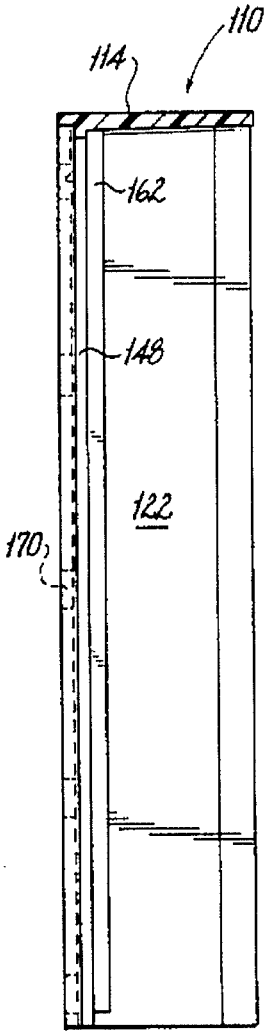
FIG. 7 is a section taken along the line 7—7 of FIG. 5.
Figure 5:
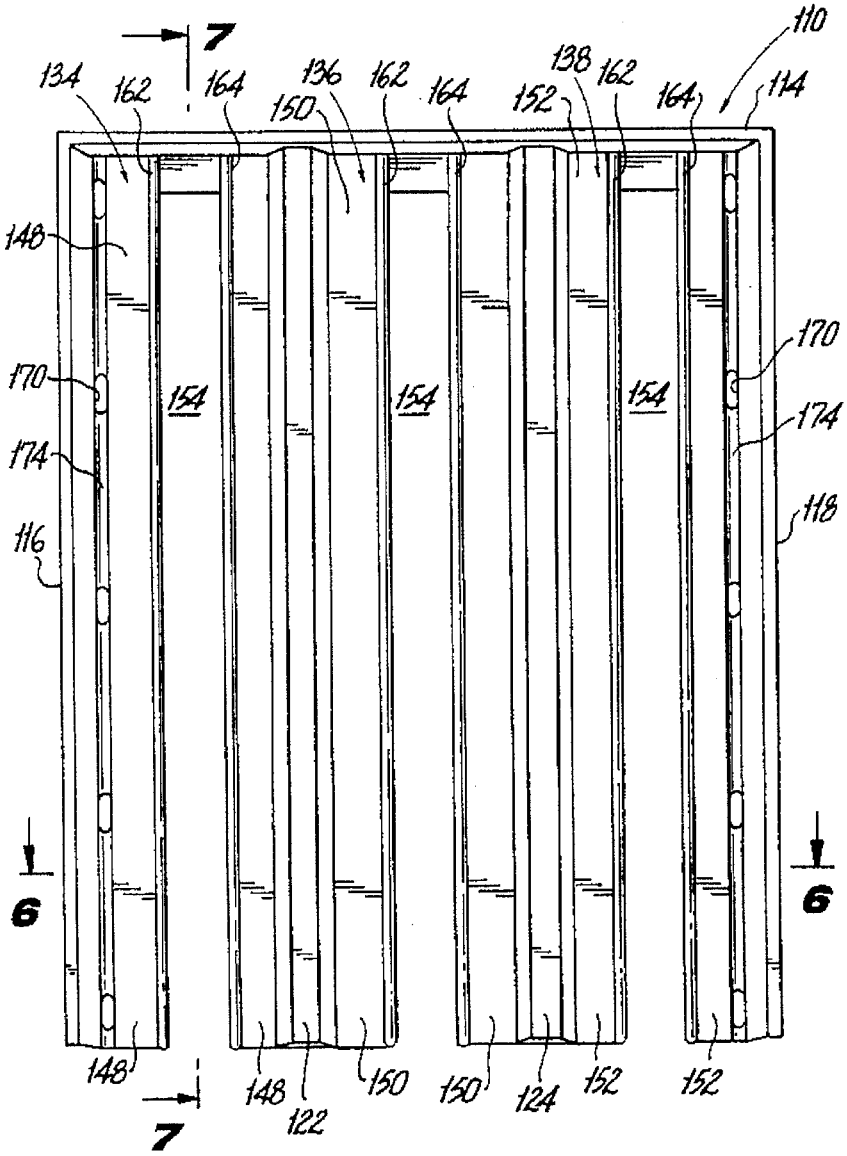
FIG. 5 is a top plan view of the back tray of the rack of the invention.
Figure 6:
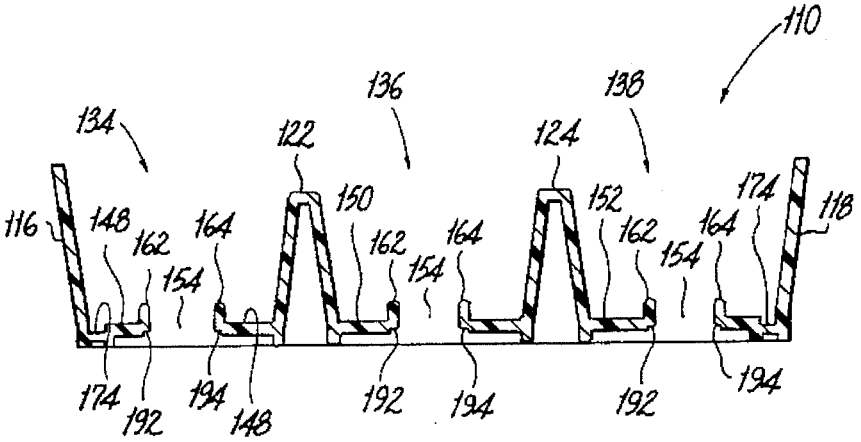
FIG. 6 is a section taken along the line 6—6 of FIG. 5.

Referring now to FIGS. 5–7, back tray 110 is an integral molded unit of a strong, rigid plastic having back wall 114, side walls 116 and 118, and divider walls 122 and 124 defining three channels 134, 136 and 138. In each channel, a floor 148, 150 and 152 respectively defines a central slot 154 and associated tracks which are preferably identical for each channel.

Slot 154 extends toward the front and back of the channel. To the left and right sides respectively of slot 154 are raised tracks 162 and 164, each generally parallel with adjacent slot 154.

The channels and the slots are integral with the floor at the back end of the back tray and extend to the front of the tray. The channels and the central slot open to free ends at the front end of the back tray.

The tracks extend above the floor as support and slide rails for the packaged products in the channel.

Figure 8:
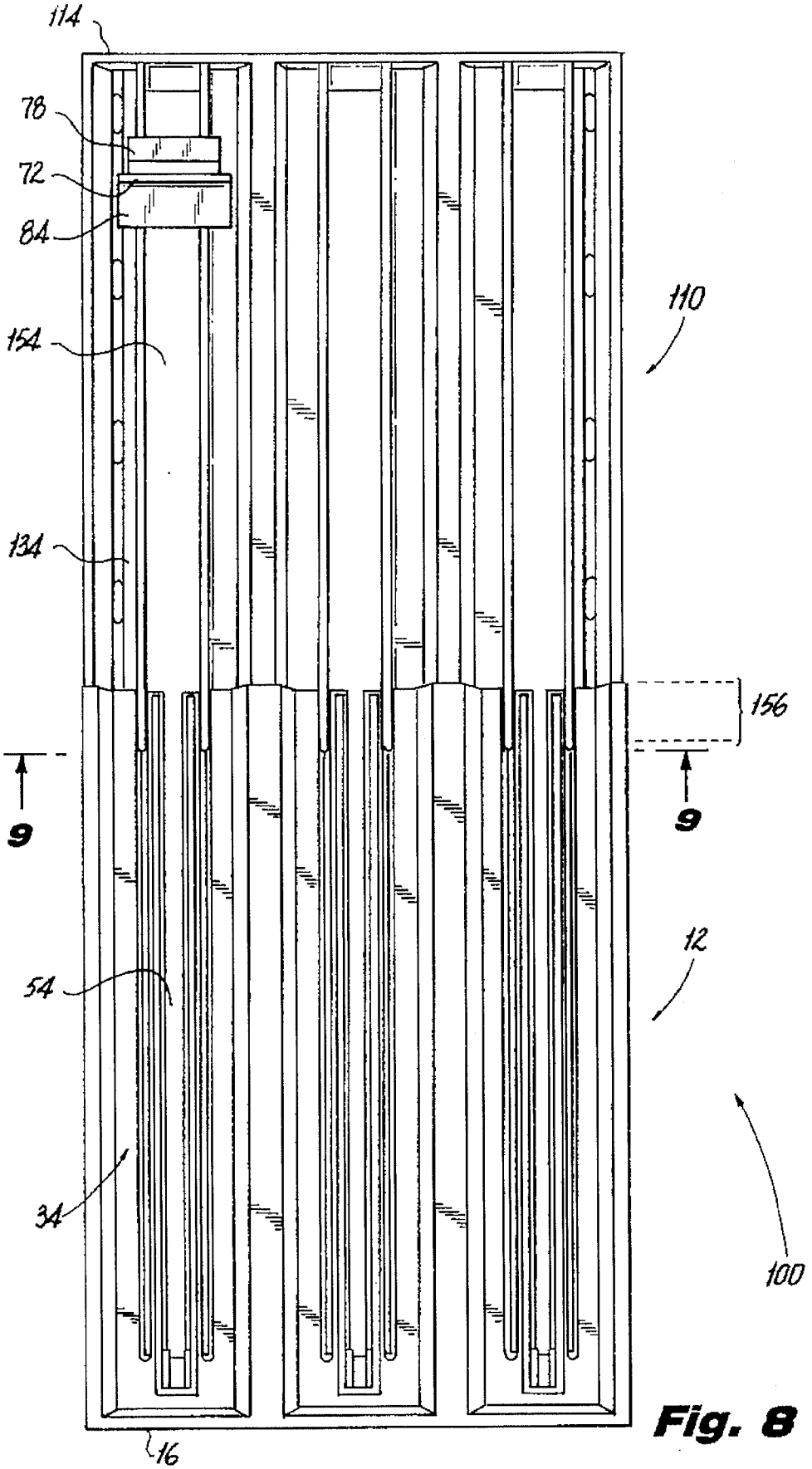
FIG. 8 is a top plan view of the front and back trays forming the rack of the invention with the back tray interfitted at its forward end with the back end of the front tray.
Figure 9:
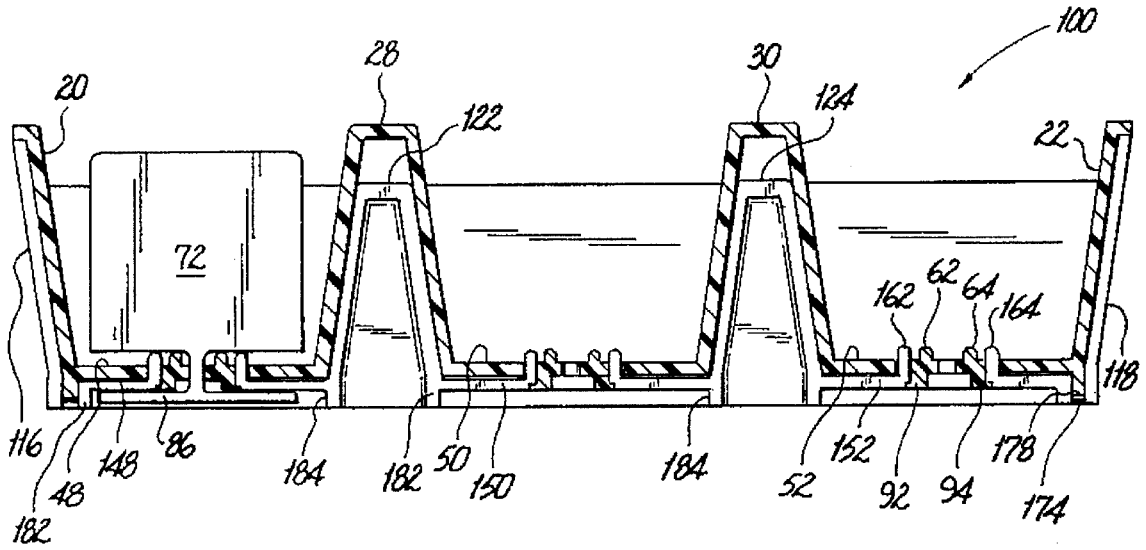
FIG. 9 is a section taken along the line 9—9 of FIG. 8.

Referring additionally now to FIGS. 8 and 9 where rack 100 back tray 110 is slidingly inserted into front tray 12 resulting in an interfit portion 156 of rack 100 where portions of trays 110 and 12 each occupy a same front-to-back distance portion of rack 100 between the front and back of rack 100. Interfit portion 156 distance becomes greater as the trays are slid together reducing the overall front-to-back length of rack 100, and conversely interfit portion 156 distance becomes smaller as the trays are drawn from full interfit toward separation.

Pusher plate 72 is shown slid back in front tray central slot 54 where when sliding back from the front of tray 12 it continues simultaneously through both central slots 54 and 154 where the front and back tray interfit, and continues on back in central slot 154 until it is held at the position shown in FIG. 8 for loading of interfitted channel 34 and 134 with product (not shown).

Central slot 154 is wider than central slot 54. This could result in lateral play of pusher plate 72 if it were not for limitation to lateral movement of foot 86 provided by left and right lower track guide walls 182 and 184.

Slide shoe 84 as shown in FIG. 8, rests on tracks 162 and 164. When the shoe is over the interfitted portion of the rack, it rests on tracks 162, 62, 64, and 164 which present the same height to the shoe. This is because tracks 162 and 164 extend up through slots 56 and 58 to a height that is about equal with the height of tracks 62 and 64.

Preferably back tray 110 is held by front tray 12 in the interfitted portion of rack 100, by upper surfaces 96 and 98 of lower L track sections 92 and 94 of front tray 12, in contact with notches 192 and 194 of tracks 162 and 164 of back tray 110. It is preferably further held by contact between floors 148, 150 and 152 of tray 110 with lower surfaces 42, 44 and 46 of floors 48, 50 and 52 of tray 12.

Index holes 170 in groove 174 are spaced front-to-back and adapted to receive pins 178 which protrude from the bottom of walls 20 and 22 of front tray 12. Pins 178 fit each of the index holes 170 sequentially when one tray moves over the other tray.

Figure 10:
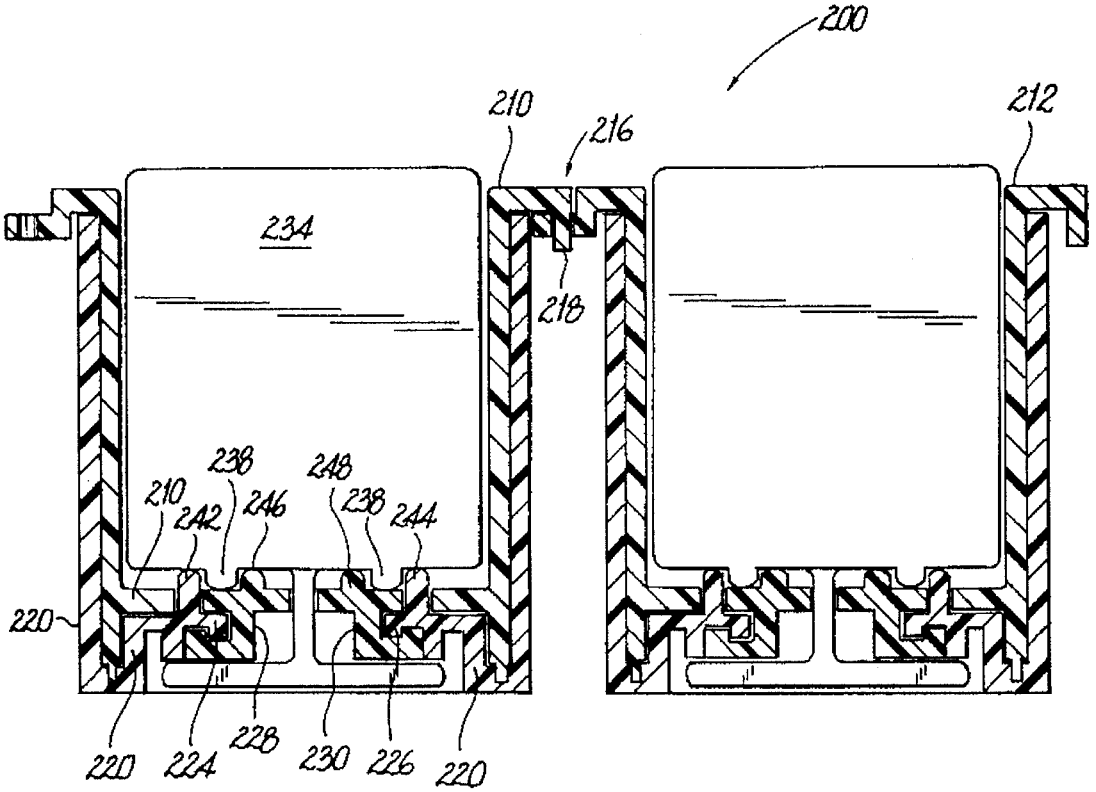
FIG. 10 is a diagrammatic view of a modification of the invention showing single channeled side-by-side display racks incorporating the invention.

In rack 200 of the embodiment shown in FIG. 10, front tray 210 is interfitted with back tray 220.

Rack 200 includes front trays 210 and 212 which are joined together laterally by tongue and groove 216. Within tongue and groove 216, pin 218 prevents relative forward and back movement between the two trays. Rack 200 can be expanded laterally to any number of trays desired.

Another feature of rack 200 is the holding of back tray 220 by front tray 210 by G shaped guide grooves 224 and 226 of lower track lugs 228 and 230.

A further feature of rack is that resistance to lateral movement of pusher plate 234 is provided by guide tabs 238 which engage raised tracks 242 and 244 when the plate is in the back tray, engage raised tracks 242, 246, 248, and 244 when the plate is in the interfitted portion of rack 200, and engage tracks 246 and 248 when pusher plate 234 is in front tray 210.

Although the invention has been described in terms of specific preferred embodiments, it will be obvious to one skilled in the art that various modifications and substitutions are contemplated by the invention. All such modifications and substitutions are included within the scope of the invention as it is defined in the appended claims.

I claim:

1. A rack having selectively variable capacity for displaying and dispensing of items, said rack including a front end, a back end, and at least one rack display and dispensing channel, a first product dispensing tray at said front end, and a second product dispensing tray behind said first tray, said first and said second trays each having at least one tray display and dispensing channel, said rack further comprising:

telescoping interfitting means, comprising said first and second trays, for joining and aligning said first and second trays in a plurality of telescoping positions to vary the display and dispensing capacity of said rack, said tray display and dispensing channels of said first and second trays being in alignment to form said at least one rack display and dispensing channel, a first pair of spaced parallel tracks in and along said at least one aligned channel of one of said trays, said first pair of tracks being in said one aligned channel and extending upward to a predetermined height, parallel slots alongside each of said tracks of said one of said trays, a second pair of spaced parallel tracks in and along said at least one aligned channel of the other of said trays, said second pair of tracks extending through said parallel slots of said one of said trays and upward to said predetermined height.

2. The rack described in claim 1, further comprising:

resisting means for resisting rearward movement of items in said first tray; and mounting means on said rack for mounting said resisting means, so that said resisting means is movable along said first and said second pair of tracks on said rack between said front end and said back end over said first and second trays, said tracks all extending to said predetermined height.

3. The rack described in claim 1 or 2, further comprising:

a track means and a slot means each including a pair of upward, downward, laterally leftward and laterally rightward engagement surfaces for limiting vertical and lateral displacement of said first tray from said second tray when said first and second trays are telescopically interfitted.

4. The rack described in claim 3, further comprising:

on one of said first and second trays at least one of said pair of laterally leftward and laterally rightward engagement surfaces has a vertical protrusion, and the other of said first and second trays has at least one elongated, front-to-back oriented, vertically opening slot for receiving said vertical protrusion.

5. The rack described in claim 1, further comprising:

resisting means for resisting rearward movement of items in said first tray, and means on said rack for mounting said resisting means so that said resisting means is movable on said rack between said front end and back end over said first and second trays.

6. The rack described in claim 5, further comprising:

said mounting means for mounting said resisting means comprising guide means between said resisting means and said rack, said guide means being oriented front-to-back, and comprising said first and second trays.

7. The rack described in claim 6, further comprising:

said guide means comprising a first front-to-back oriented slot in said first tray, and a second front-to-back oriented slot in said second tray, said first and second slots opening into one another, said resisting means extending into at least one of said first and second slots when moving on said rack over said pairs of spaced parallel tracks of said first and second trays of said rack.

8. A rack having selectively variable capacity for displaying and dispensing of items, said rack including a front end, a back end, and at least one display and dispensing channel, a first product dispensing tray at said front end, and a second product dispensing tray behind said first tray, said first and said second trays each having at least one display and dispensing channel, said rack further comprising: telescoping interfitting means, comprising said first and second trays, for joining and aligning said first and second trays in a plurality of telescoping positions to vary the display and dispensing capacity of said rack, each of said first and second trays having at least one display and dispensing channel in alignment to form said at least one channel of said rack, said telescoping interfitting means comprising track means and slot means cooperating between said first and second trays, said track and said slot means being oriented back-to-front, said track means and said slot means each including a pair of upward, downward, laterally leftward and laterally rightward engagement surfaces for limiting vertical and lateral displacement of said first tray from said second tray when said first and second tray are telescopically interfitted, said pair of laterally leftward and laterally rightward engagement surfaces comprising a vertical protrusion on a one of said first and second trays, an elongated, front-to-back oriented, vertically opening slot on the other of said first and second trays, for receiving said vertical protrusion, said pair of upward and downward engagement surfaces comprising a horizontal portion of one of said trays, and an L-shaped extension on said other tray for receiving said horizontal portion.

9. The rack described in claim 1 or 8 being a first rack, and further comprising:

attaching means on said first rack for attaching laterally to said first rack a second rack for displaying and dispensing of items.

10. The rack described in claim 8, further comprising:

a one of said first and second trays comprising a front-to-back oriented, vertical third slot opening through the tray, and a first ridge adjacent to and parallel with said third slot, the other of said first and second trays comprising a second ridge extending vertically through and above said third slot, said resisting means being in contact with at least one of said first and second ridges when moving on said rack over said first and second trays.

11. The rack described in claim 10, further comprising:

a resisting means extending laterally below said first and second trays.

12. The rack described in claim 11, further comprising:

a plurality of discrete, front-to-back spaced, openings in a one of said first and second trays, and said protrusion on the other of said first and second trays which fits each of said openings sequentially when one tray moves over the other tray.

* * * * *